US008239975B2

(12) United States Patent
Lee

(10) Patent No.: US 8,239,975 B2
(45) Date of Patent: Aug. 14, 2012

(54) DISTANCE WARNING DEVICE FOR A MALE URINAL

(76) Inventor: Shuen-Ching Lee, Taipei County (TW)

( * ) Notice: Subject to any disclaimer, the term of this patent is extended or adjusted under 35 U.S.C. 154(b) by 266 days.

(21) Appl. No.: 12/805,541

(22) Filed: Aug. 5, 2010

(65) Prior Publication Data

US 2011/0168928 A1 Jul. 14, 2011

(30) Foreign Application Priority Data

Jan. 11, 2010 (TW) ..... 99200525 U

(51) Int. Cl.
*E03D 13/00* (2006.01)

(52) U.S. Cl. ..... 4/304

(58) Field of Classification Search ..... 4/302–305, 4/313, 623
See application file for complete search history.

(56) References Cited

U.S. PATENT DOCUMENTS 6,581,215 B1 * 6/2003 Tai ..... 4/304
6,671,890 B2 * 1/2004 Nishioka ..... 4/304
7,437,778 B2 * 10/2008 Parsons et al. ..... 4/249

* cited by examiner

*Primary Examiner* — Huyen Le
(74) *Attorney, Agent, or Firm* — Bacon & Thomas, PLLC

(57) ABSTRACT

A distance warning device for a male urinal comprises a casing, a detector provided at the front end of the casing, and a comparison circuit, a control circuit, and a warning indicator that are electrically connected with the detector. The detector detects the location of a human body. The comparison circuit then outputs a corresponding signal by means of comparison of the detection results. When receiving a signal indicating that the distance from the human body to the male urinal is between the first distance and the second distance, the control circuit has the warning indicator output a warning signal and has a flusher begin a first-phase flush to pre-wet the male urinal. When receiving a signal indicating that the human body is within the first distance, the control circuit stops the warning indicator. When the distance between the human body and the male urinal is equal to or longer than the second distance, the flusher begins the second-phase flush to wash the male urinal.

7 Claims, 4 Drawing Sheets

DISTANCE WARNING DEVICE FOR A MALE URINAL

TECHNICAL FIELD

The present invention relates to a warning device and, more particularly, to a distance warning device for a male urinal, where the device can output a warning signal to alert a user to approach the male urinal closer in order to have urine completely dropped into the male urinal.

BACKGROUND

In today's households, toilets are primary used for disposal of people's excretion. In the washrooms in public areas (such as schools, companies, or shopping malls), toilets and male urinals are usually installed therein to meet various requirements from different users.

Different people own different hygienic habits, and it is not uncommon to find that some users will begin to urinate when not approaching the male urinals close enough. In this case, urine would be dropped outside rather than directly into the male urinals. Consequently, not only does the ground become wet and dirty which causes problems of environmental sanitation, but also the workload of the cleaning staff is made heavier.

In order to overcome above shortcomings, inventor had the motive to study and develop the present invention to provide a distance warning device for a male urinal, designed to alert users to approach much closer to the male urinal to have the urine completely dropped into the male urinal, so as to maintain the environmental sanitation and to relieve the workload of the cleaning staff.

SUMMARY OF THE DISCLOSURE

An object of the present invention is to provide a distance warning device for a male urinal, designed to output a warning signal when detecting that the distance between a user and the urinal is not long enough to have the urine completely dropped into the male urinal. Thereby, urine will not be dropped outside the urinal so as to maintain the environmental sanitation and to relieve the workload of the cleaning staff.

Another object of the present invention is to provide a distance warning device for a male urinal, designed to output a warning signal when detecting that the distance between a user and the urinal is not long enough to have the urine completely dropped into the male urinal and that the user stays at that position for a period longer than a preset time. Thereby, it is able to ensure the accuracy in detecting human body's position so as to precisely control the warning signal and the operation of flusher.

In order to achieve above objects, the present invention provides a distance warning device for a male urinal, which comprises a casing, a detector, a comparison circuit, a control circuit, and a warning indicator. The detector is provided at the front end of the casing and for detecting the location of a human body. The comparison circuit is electrically connected with the detector and is used for comparing and outputting a signal indicating that the distance between the human body and the male urinal is shorter than a first distance or is between the first distance and a second distance. The control circuit is electrically connected with the comparison circuit.

Thereby, when receiving a signal indicating that the distance from the human body to the male urinal is between the first distance and the second distance, the control circuit controls a warning indicator to output a warning signal and to have a flusher begin a first-phase flush to pre-wet the male urinal. When receiving a signal indicating that the human body's location is within the first distance, the control circuit stops the warning indicator; and when receiving a signal indicating that the distance between the human body and the male urinal is equal to or longer than the second distance, the control circuit controls via a processor the flusher to begin a second-phase flush to wash the male urinal.

In practice, the comparison circuit is an analog circuit. The comparison circuit includes a first comparator and a second comparator. The first and the second comparators are respectively electrically connected with the detector and are used for obtaining respectively a signal indicating that the distance from the human body to the urinal is between the first and the second distances or a signal indicating that the human body's position is within the first distance.

In practice, the comparison circuit and the control circuit are respectively a firmware that is pre-installed in a processor, so as to process the comparison in the processor by a program for obtaining the information regarding human body's position and then for controlling the warning indicator and the flusher. A converter is electrically connected between the detector and the processor for converting analog signals to digital signals and inputting the digital signals into the processor.

The following detailed description, given by way of examples or embodiments, will best be understood in conjunction with the accompanying drawings.

DETAILED DESCRIPTION

Figure 1:
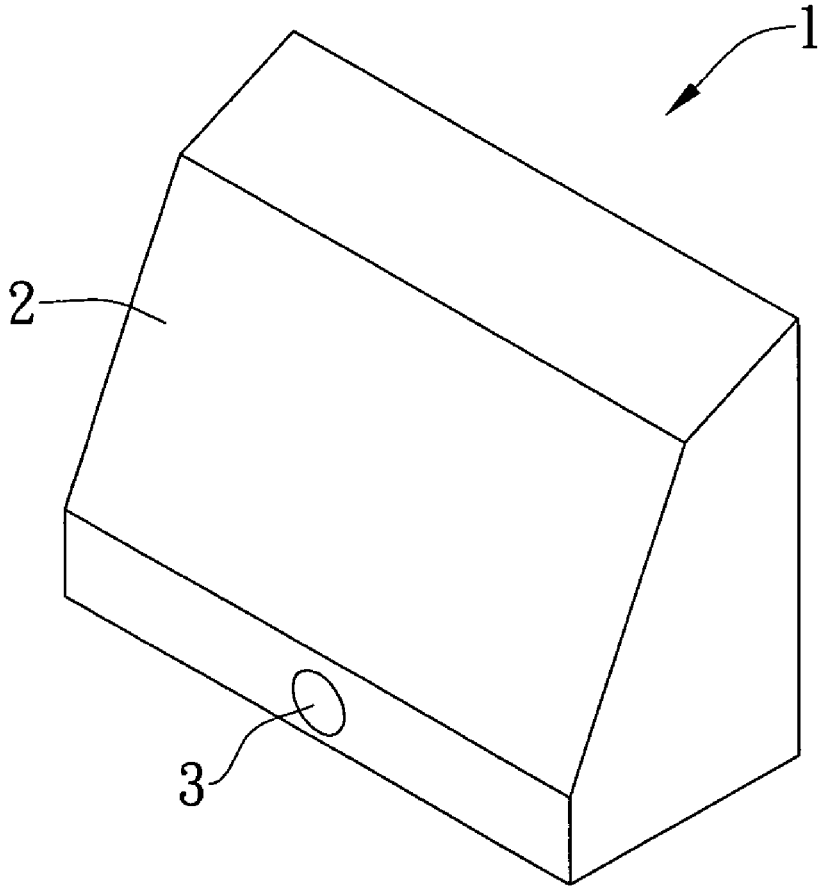
FIG. 1 is a perspective view of a first embodiment of a distance warning device for a male urinal of the present invention.
Figure 2:
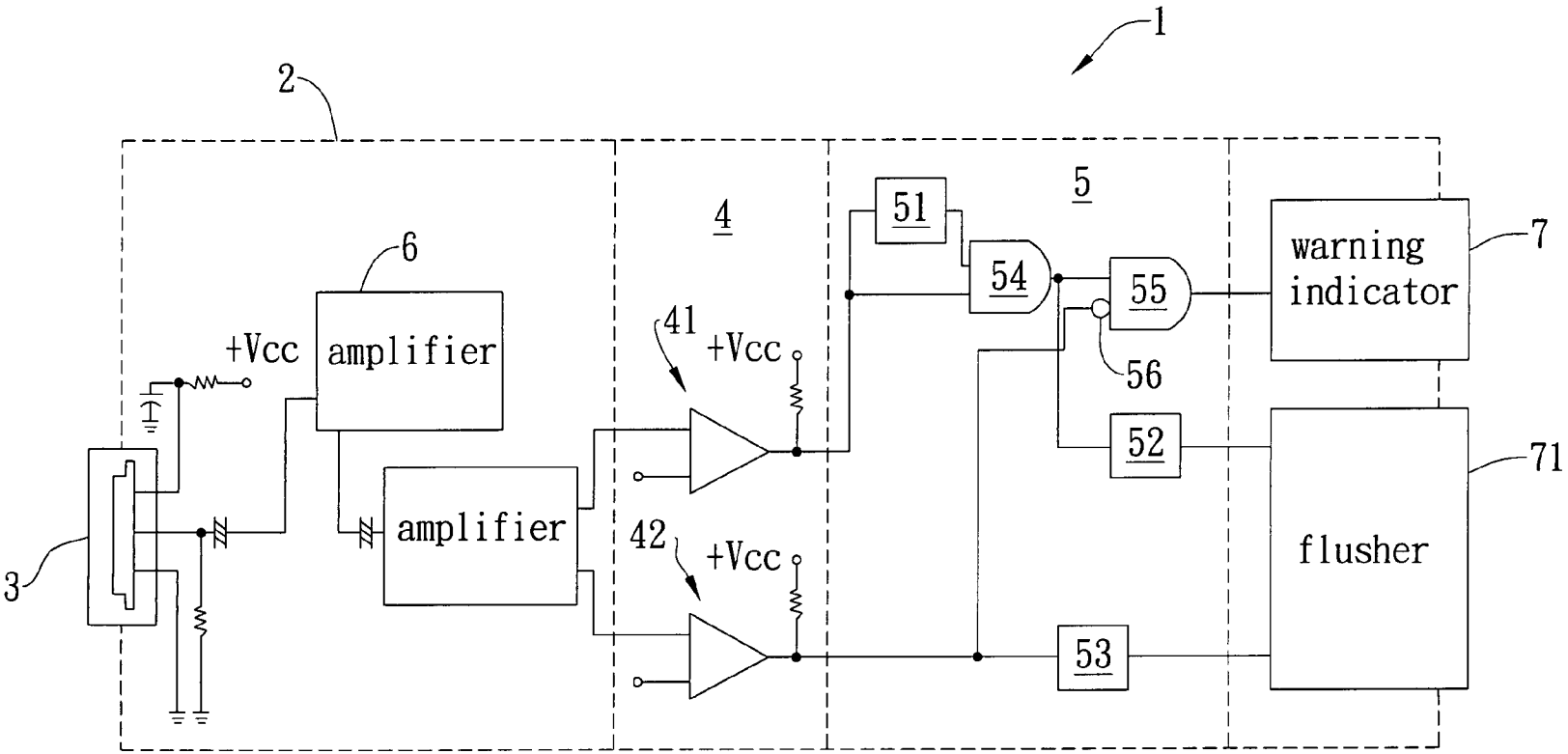
FIG. 2 is a schematic view showing the circuit in the first embodiment of the distance warning device for a male urinal of the present invention.

Please refer to FIGS. 1 and 2 showing a first embodiment of a distance warning device for a male urinal according to the present invention, where the device 1 comprising a casing 2, a detector 3, a comparison circuit 4, and a control circuit 5.

The casing 2 is in rectangular shape and has a slightly oblique front end. Besides, the casing 2 also can be in any other three-dimensional shapes. Within the casing 2 defines a space. The rear end of the casing 2 is connected to a wall. In practice, the casing 2 can be directly embedded into the wall or into the front top of a male urinal.

The detector 3 is a photoelectric sensor. Besides, the detector 3 is provided at the front end of the casing 2 for detecting a human body's location. In response to different environmental requirements, the detector also can be a human body (electricity-heat-release) sensor, an ultrasonic sensor, or a microwave sensor, all of which have the function of detecting the human body's location.

Figure 3:
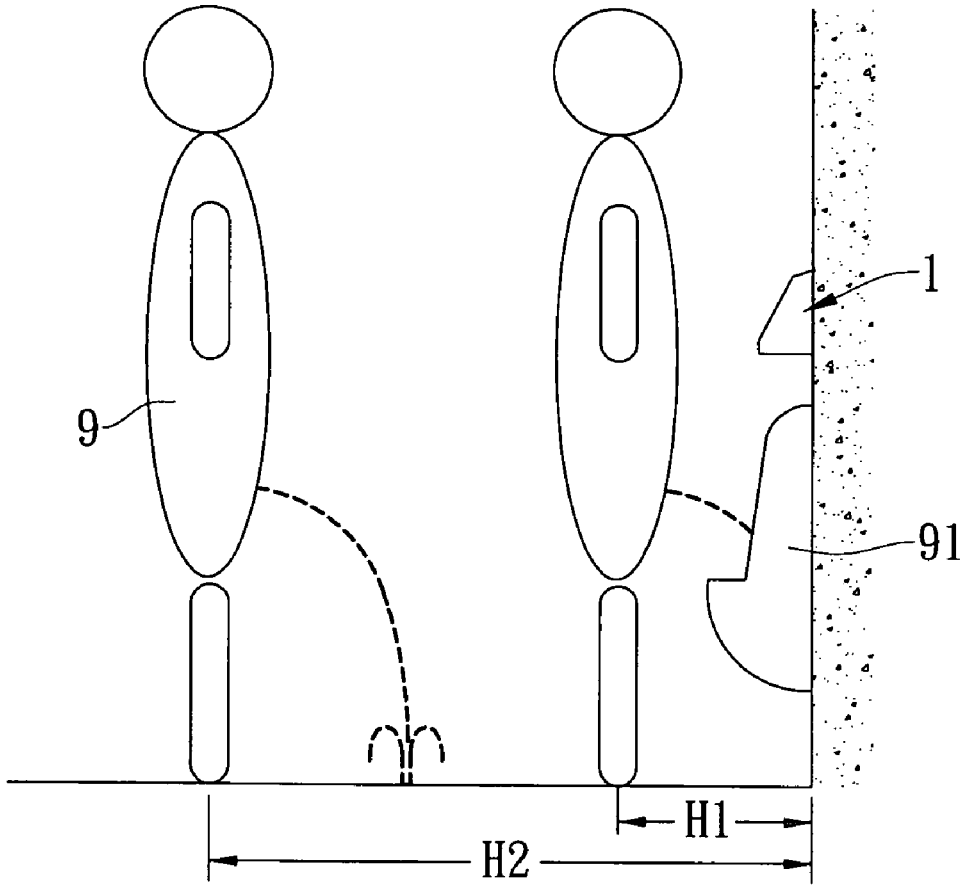
FIG. 3 is a schematic view showing human body's position in the first embodiment of the distance warning device for a male urinal of the present invention.

The comparison circuit 4 includes a first comparator 41 and a second comparator 42. The first and the second comparators 41, 42 are respectively electrically connected with the detector 3 and are used for undertaking comparison and outputting a signal indicating that the distance between the human body 9 and the male urinal 91 is shorter than the first distance H1 or is between the first distance H1 and the second distance H2, as shown in FIG. 3. In practice, when the strength of the signal picked up by the detector 3 is not strong enough, two amplifiers 6 in serial connection are to be electrically connected between the detector 3 and the comparison circuit 4 so as to amplify the primary and secondary signals of the output signals from the detector 3 for use in later stages. In practice, one amplifier 6 can be provided to meet the requirements. Besides, the first and the second comparators 41, 42 can be provided with preset comparison voltage values. Thereby, when the amplifier 6 inputs an amplified voltage, it is able to determine whether the distance from the human body 9 to the male urinal 91 is between the first distance H1 and the second distance H2 or whether the human body's 9 position is within the first distance H1.

The control circuit 5 is electrically connected with the comparison circuit 4. The control circuit 5 includes a first time-delay circuit 51, a second time-delay circuit 52, a third time-delay circuit 53, a first AND gate 54, a second AND gate 55, and an inverter 56, all of which are electrically connected with each other.

Thereby, when the distance from human body 9 to the urinal 91 is detected to be between the first distance H1 and the second distance H2 via the comparison of the comparator 41, the output of the first comparator is "1" while the output of the second comparator 42 is "0". For the time being, if the two input ends of the first AND gate 54 are simultaneously input with a signal of "1" within the time interval set by the first time-delay circuit 51, the output end of the first AND gate 54 will be "1". The output of the second comparator 42 is "0", and by inverting the output to be "1" via the inverter 56, it is able to have the two input ends of the second AND gate 55 simultaneously input with a signal of "1" so as to control the warning indicator 7 to output warning signals and control the flusher 71 to begin a first-phase flush for pre-wetting the male urinal within the time interval set by the second time-delay circuit 52.

When the human body's 9 position is known to be within the first distance H1 via the comparison of the second comparator 42, the output of the first comparator 41 is "0" while the output of the second comparator 42 is "1". At this time, the operation of the warning indicator 7 and the pre-wetting are stopped. When the distance from the human body 9 to the male urinal 91 is longer than or equal to the second distance H2, the flusher 71 will begin a second-phase flush to wash the male urinal within the time interval set by the third time-delay circuit 53.

Figure 4:
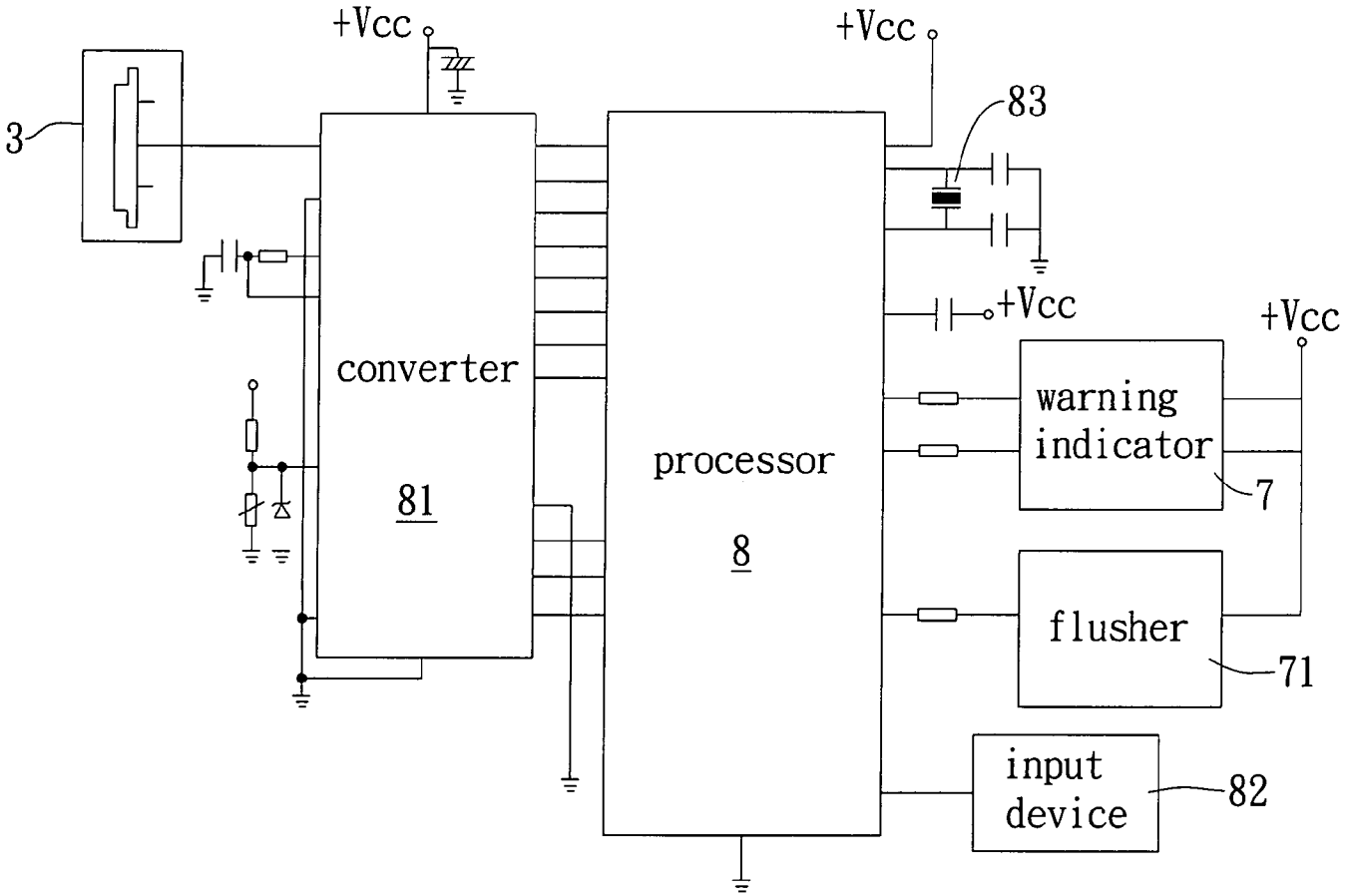
FIG. 4 is a schematic view showing the circuit in a second embodiment of the distance warning device for a male urinal of the present invention.

Refer to FIG. 4 showing a second embodiment of a distance warning device for a male urinal according to the present invention. As shown in this figure, the difference between this embodiment and the first embodiment is that: an analog circuit is used in the first embodiment while a digital circuit is used in this embodiment. In this embodiment, the comparison circuit 4 and the control circuit 5 are respectively a firmware pre-installed in a processor 8. A converter 81 is electrically connected between the detector 3 and the processor 8 for converting the analog signals output from the detector 3 to digital signals. A keyboard can be used as an input device 82, by which the values of the first distance H1 and the second distance H2 can be input into the processor 8. A quartz oscillator 83 is used to provide frequency to the processor 8 for computing time. By means of the operation of the firmware's program, it is able to control the warning indicator to output warning signals and to control the flusher 71 to begin the first-phase flush of pre-wetting the male urinal when the distance from the human body 9 to the male urinal 91 is between the first distance H1 and the second distance H2; and is able to control the flusher 71 to begin the second-phase flush to wash the male urinal when the human body 9 leaves.

Therefore, the present invention has following advantages:

1. According to the present invention, it is able to alert a user to urinate within a preset distance from the user's body to the male urinal. Therefore, it can prevent the urine being dropped outside the male urinal so as to maintain the environmental sanitation and decrease the workload of the cleaning staff.
2. According to the present invention, the operation of the warning indicator and the flusher are actuated only when the user intends to urinate. Thereby, it is able to ensure the accuracy of the detection.

As disclosed in above descriptions and attached drawings, the present invention provides a distance warning device for a male urinal, designed to alert a user to approach the male urinal closer to have the urine completely dropped into the urinal and thereby maintaining the environmental sanitation and relieving the workload of the cleaning staff. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A distance warning device for a male urinal, comprising:

a casing;

a detector, provided at the front end of the casing, for detecting the location of a human body;

a comparison circuit, electrically connected with the detector, for comparing and outputting a signal indicating that the distance between the human body and the male urinal is shorter than a first distance or is between the first distance and a second distance; and a control circuit, electrically connected with the comparison circuit, where when receiving a signal indicating that the distance from the human body to the male urinal is between the first distance and the second distance, the control circuit controls a warning indicator to output a warning signal and to have a flusher begin a first-phase flush to pre-wet the male urinal; when receiving a signal indicating that the distance between the human body and the male urinal is smaller than the first distance, the control circuit stops the warning indicator; and when receiving a signal indicating that the distance between the human body and the male urinal is equal to or longer than the second distance, the control circuit controls via a processor the flusher to begin a second-phase flush to wash the male urinal.

2. The distance warning device for a male urinal as claimed in claim 1, wherein the comparison circuit further includes a first comparator and a second comparator; the first and the second comparators are respectively electrically connected with the detector; and the first comparator is used for determining whether the distance from the human body to the male urinal is between the first and the second distance while the second comparator is used for determining whether the distance from the human body to the male urinal is smaller than the first distance.

3. The distance warning device for a male urinal as claimed in claim 2, further comprising at least an amplifier that is electrically connected with the detector for amplifying the signals from the detector.

4. The distance warning device for a male urinal as claimed in claim 1, wherein the comparison circuit and the control circuit are respectively a firmware that is pre-installed in a processor; and a converter is electrically connected between the detector and the processor for converting analog signals to digital signals.

5. The distance warning device for a male urinal as claimed in claim 4, wherein the processor is electrically connected with an input device for inputting the values of the first and the second distances.

6. The distance warning device for a male urinal as claimed in claim 5, wherein the processor is electrically connected with a quartz oscillator.

7. The distance warning device for a male urinal as claimed in claim 4, further comprising at least an amplifier that is electrically connected with the detector for amplifying the signals from the detector.

* * * * *